US006761142B2

(12) United States Patent
Suzuki et al.

(10) Patent No.: US 6,761,142 B2
(45) Date of Patent: Jul. 13, 2004

(54) OIL PRESSURE CONTROL FOR AN OUTBOARD MOTOR

(75) Inventors: Masaru Suzuki, Hamamatsu (JP); Sadato Yoshida, Hamamatsu (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 37 days.

(21) Appl. No.: 10/135,177

(22) Filed: Apr. 29, 2002

(65) Prior Publication Data

US 2002/0179375 A1 Dec. 5, 2002

Related U.S. Application Data

(60) Provisional application No. 60/322,239, filed on Sep. 13, 2001.

(30) Foreign Application Priority Data

Apr. 27, 2001 (JP) ..... 2001-132607

(51) Int. Cl.[7] ..... F01M 1/00

(52) U.S. Cl. ..... 123/196 R; 123/196 S; 123/198 D

(58) Field of Search ..... 123/196 R, 196 S, 123/198 D, 198 R; 340/451, 500, 501, 450.3

(56) References Cited

U.S. PATENT DOCUMENTS

| | | | | |
|---|---|---|---|---|
| 4,504,819 A | * | 3/1985 | Hosoya | 340/450.3 |
| 5,669,349 A | | 9/1997 | Iwata et al. | |
| 6,111,499 A | | 8/2000 | Morikami | |
| 6,113,442 A | | 9/2000 | Nakamura | |
| 6,131,539 A | * | 10/2000 | Thomas | 123/41.15 |

FOREIGN PATENT DOCUMENTS

| | | |
|---|---|---|
| JP | 09-236172 | 9/1997 |
| JP | 2000-045745 | 2/2000 |
| JP | 2001-271622 | 10/2001 |
| JP | 2001-342812 | 12/2001 |

* cited by examiner

*Primary Examiner*—Tony M. Argenbright
*Assistant Examiner*—Katrina B. Harris
(74) *Attorney, Agent, or Firm*—Knobbe, Martens, Olson & Bear, LLP

(57) ABSTRACT

An oil pressure control warning system for an outboard motor which uses timers dependent on various predetermined oil pressures to correctly determine actual harmful lubrication deficiencies and warn the operator of such lubrication deficiencies. The alarm warning can include an audible and visual operation and is turned off as soon as the correct oil pressure is resumed.

32 Claims, 11 Drawing Sheets

OIL PRESSURE CONTROL FOR AN OUTBOARD MOTOR

PRIORITY INFORMATION

This application is based on and claims priority to Japanese Patent Application No. 2001-132607, filed Apr. 27, 2001 and to the Provisional Application No. 60/322,239, filed Sep. 13, 2001, the entire contents of which is hereby expressly incorporated by reference.

FIELD OF THE INVENTION

The present invention relates generally to an oil pressure system for an engine, and more particularly to an oil pressure monitoring system to warn the operator of an inadequate lubrication pressure in a watercraft engine.

DESCRIPTION OF THE RELATED ART

Watercraft engines typically incorporate lubrication systems. The lubrication system embodies an oil pump driven by the engine and provides lubricant under pressure to vital moving parts throughout the engine. The lubricant acts to lubricate as well as help cool these vital moving parts of the engine.

Watercraft may operate in rough water environments. The oil pump in the lubrication system may suck up air instead of the intended lubricant because the oil is being pushed away from the oil pump suction passage during rough operation. The importance of the lubrication system is essential and therefore many lubrication systems incorporate a monitoring system with an alarm in order to warn the operator if the oil pressure is inadequate to safely lubricate the engine.

SUMMARY OF THE INVENTION

Certain reductions in oil pressure are more essential to the correct engine operation than others. For example, a small drop or short reduction in oil pressure at low engine speed is less vital to the engine than if there is a lack of lubrication pressure for prolonged periods of time at higher engine speeds.

One aspect of the invention is a lubrication control system wherein the oil pressure is accurately monitored for the higher engine speeds and operational environments in order to provide the operator with a precise condition of the lubrication system. Such an advanced lubrication control system allows for a long, maintenance free engine life.

Another aspect of the present invention is to accurately monitor the engine lubrication pressure and compare the measured pressure with a calculated pressure dependent on engine speed, engine temperature, and oil temperature. A further aspect of the present invention further sets oil pressure limits each corresponding to a timer. The operator is given warning if the oil pressure falls below a set limit for an extended period of time as set by a corresponding limit timer.

BRIEF DESCRIPTION OF THE DRAWINGS

The foregoing features, aspects, and advantages of the present invention will now be described with reference to the drawings of a preferred embodiment that is intended to illustrate and not to limit the invention. The drawings comprise eleven figures in which.

DETAILED DESCRIPTION OF THE PREFERRED EMBODIMENTS

The Overall Construction

Figure 1:
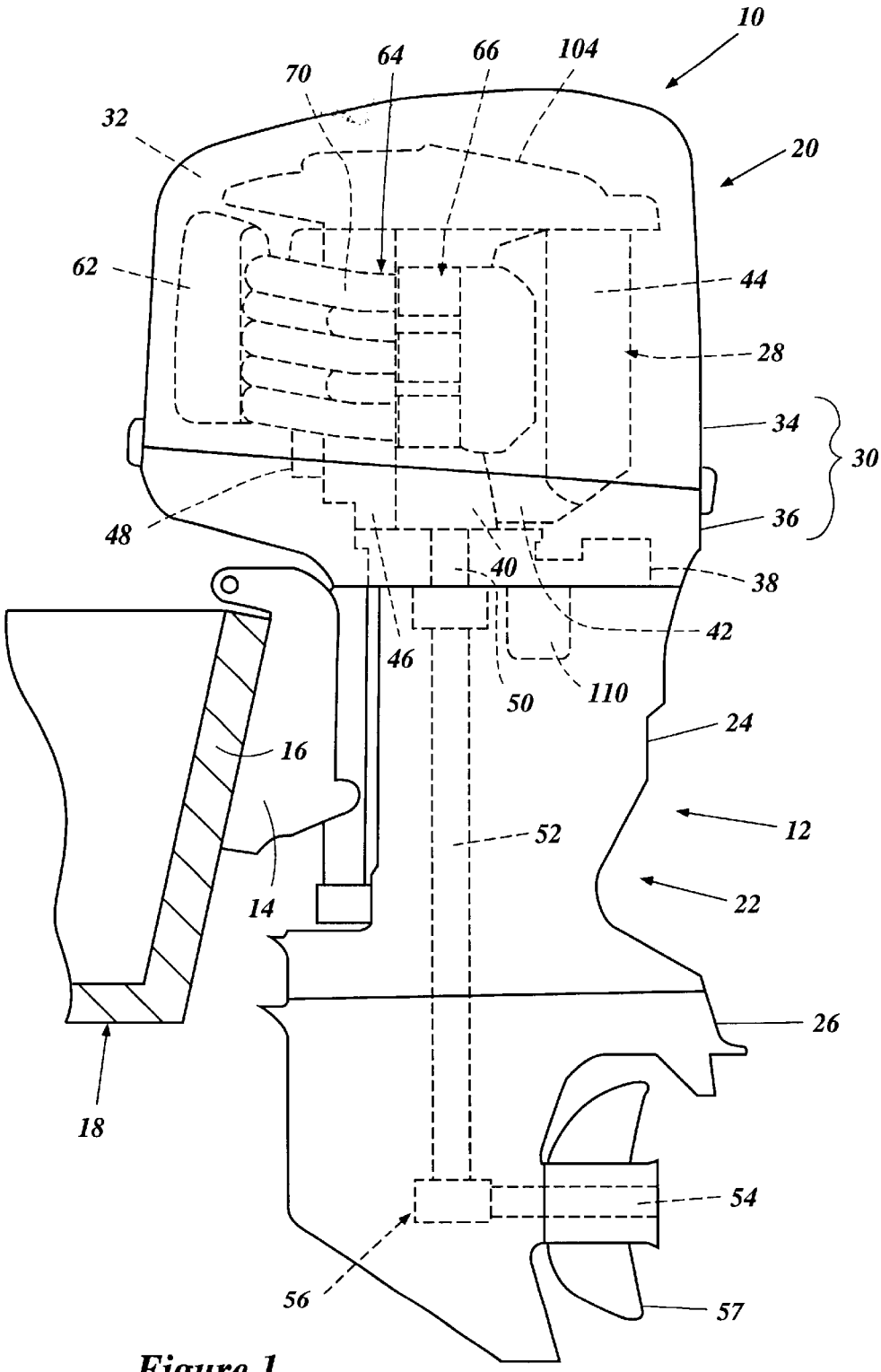
FIG. 1 is a side elevational view of an outboard motor configured in accordance with a preferred embodiment of the present invention, with an associated watercraft partially shown in section.

With reference to FIGS. 1–5, an outboard motor 10 includes a drive unit 12 and a bracket assembly 14. The bracket assembly 14 attaches the drive unit 12 to a transom 16 of an associated watercraft 18 and supports a marine propulsion device such as propeller 57 in a submerged position relative to a surface of a body of water.

As used to this description, the terms "forward," "forwardly," and "front" mean at or to the side where the bracket assembly 14 is located, unless indicated otherwise or otherwise readily apparent from the context use. The terms "rear," "reverse," "backwardly," and "rearwardly" mean at or to the opposite side of the front side.

The illustrated drive unit 12 includes a power head 20 and the housing unit 22. Unit 22 includes a drive shaft housing 24 and the lower unit 26. The power head 20 is disposed atop the housing unit 22 and includes an internal combustion engine 28 within a protective cowling assembly 30, which advantageously is made of plastic. The protective cowling assembly 30 typically defines a generally closed cavity 32 in which the engine 28 is disposed. The engine 28 is thereby is generally protected by the cowling assembly 30 from environmental elements.

The protective cowling assembly 30 includes a top cowling member 34 and a bottom cowling member 36. The top cowling member 34 is advantageously detachably affixed to the bottom cowling member 36 by a suitable coupling mechanism to facilitate access to the engine and other related components.

The top cowling member 34 includes a rear intake opening (not shown) defined from an upper end portion. This rear intake member with one or more air ducts can, for example, be formed with, or affixed to, the top cowling member 34. The rear intake member, together with the upper rear portion of the top cowling member 34, generally defines a rear air intake space. Ambient air is drawn into the closed cavity 32 near the rear intake opening and the air ducts of the rear intake member. Typically, the top cowling member 34 tapers in girth toward its top surface, which is in the general proximity of the air intake opening. This taper reduces the lateral dimension of the outboard motor, which helps to reduce the air drag on the watercraft 18 during movement.

The bottom cowling member 36 has an opening for which an upper portion of an exhaust guide member 38 extends. The exhaust guide member 38 advantageously is made of aluminum alloy and is affixed to the top of the driveshaft housing 24. The bottom cowling member 36 and the exhaust guide member 38 together generally form a tray. The engine 28 is placed on to this tray and can be connected to the exhaust guide member 38. The exhaust guide member 38 also defines an exhaust discharge passage through which burnt charges (e.g., exhaust gases) from the engine 28 pass.

Figure 2:
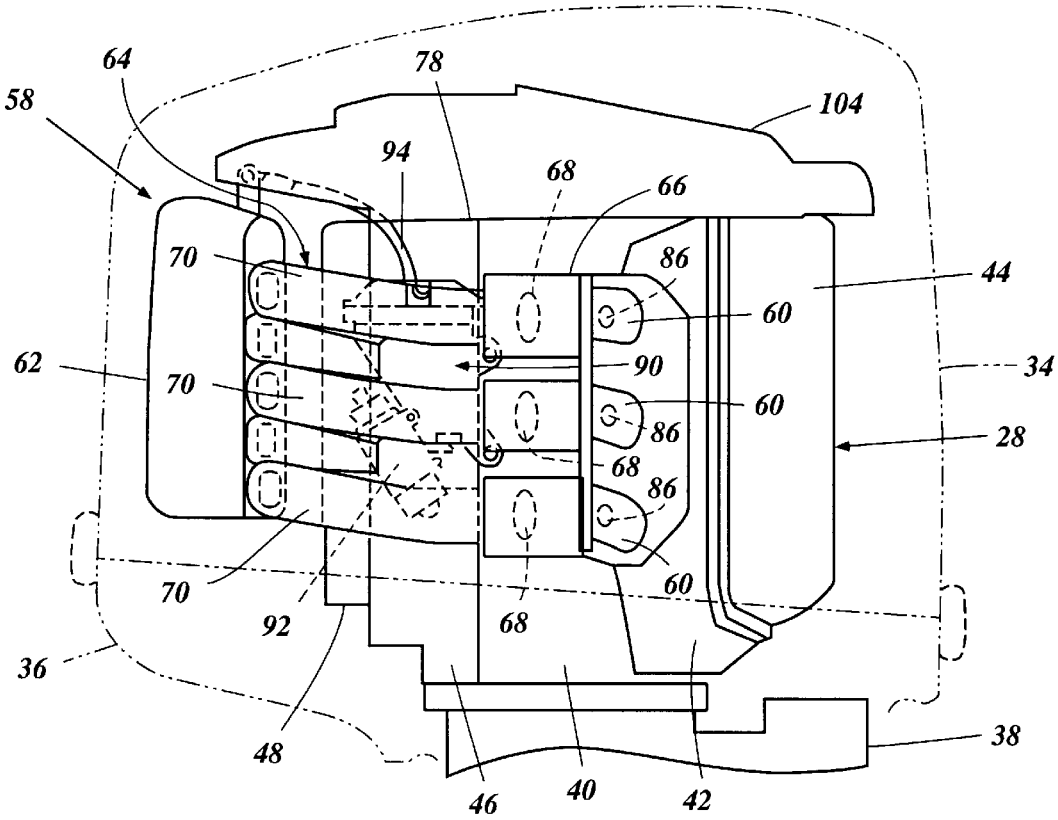
FIG. 2 is a side elevational view of an upper section of an outboard motor configured in accordance with a preferred embodiment of the present invention, with various parts shown in phantom.
Figure 3:
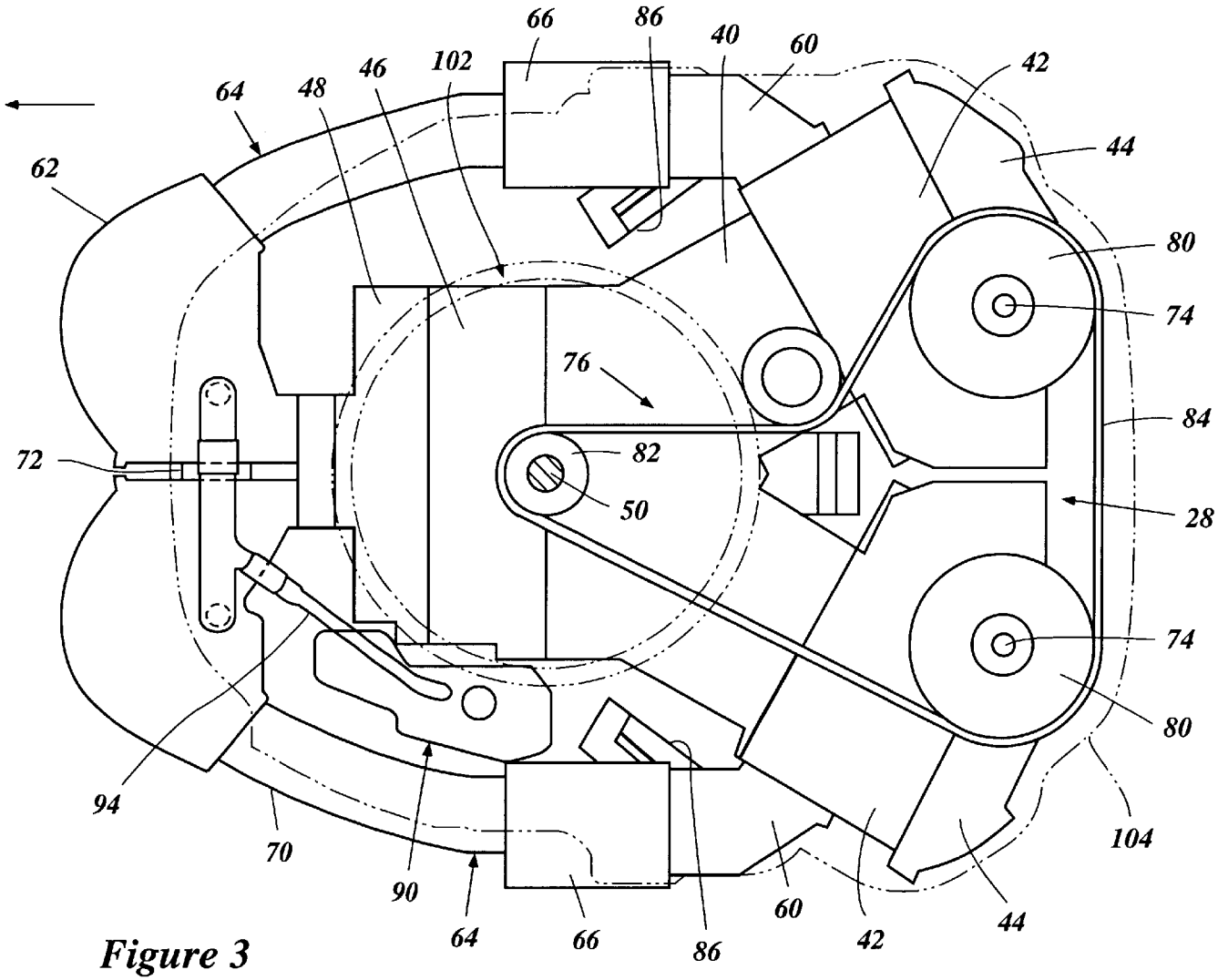
FIG. 3 is a top view of an outboard motor configured in accordance with a preferred embodiment of the present invention, with various parts shown in phantom.

The engine 28 in the illustrated embodiment preferably operates on a four-cycle combustion principle. With reference now to FIGS. 2 and 3, the engine embodiment illustrated is a DOHC six-cylinder engine having a V-shaped cylinder block 40. The cylinder block 40 thus defines two cylinder banks, which extend generally side by side with each other. In the illustrated arrangement, each cylinder bank has three cylinder bores such that the cylinder block 40 has six cylinder bores in total. The cylinder bores of each bank extend generally horizontally and are generally vertically spaced from one another. This type of engine, however, merely exemplifies one type of engine. Engines having other numbers of cylinders, having other cylinder arrangements (in line, opposing, etc.), and operating on other combustion principles (e.g., crankcase compression, two-stroke or rotary) can be used in other embodiments.

As used in this description, the term "horizontally" means that members or components extend generally and parallel to the water surface (i.e., generally normal to the direction of gravity) when the associated watercraft 18 is substantially stationary with respect to the water surface and when the drive unit 12 is not tilted (i.e., as shown in FIG. 1). The term "vertically" in turn means that proportions, members or components extend generally normal to those that extend horizontally.

A movable member, such as a reciprocating piston, moves relative to the cylinder block 40 in a suitable manner. In the illustrated arrangement, a piston (not shown) reciprocates within each cylinder bore. Because the cylinder block 40 is split into the two cylinder banks, each cylinder bank extends outward at an angle to an independent first end in the illustrated arrangement. A pair of cylinder head members 42 are fixed to the respective first ends of the cylinder banks to close those ends of the cylinder bores. The cylinder head members 42 together with the associated pistons and cylinder bores provide six combustion chambers (not shown). Of course, the number of combustion chambers can vary, as indicated above. Each of the cylinder head member 42 is covered with the cylinder head cover member 44.

A crankcase member 46 is coupled with the cylinder block 40 and a crankcase cover member 48 is further coupled with a crankcase member 46. The crankcase member 46 and a crankcase cover member 48 close the other end of the cylinder bores and, together with the cylinder block 40, define the crankcase chamber. Crankshaft 50 extends generally vertically through the crankcase chamber and journaled for rotation about a rotational axis by several bearing blocks. Connecting rods couple the crankshaft 50 with the respective pistons in any suitable manner. Thus, a reciprocal movement of the pistons rotates the crankshaft 50.

With reference again to FIG. 1, the driveshaft housing 24 depends from the power head 20 to support a drive shaft 52, which is coupled with crankshaft 50 and which extends generally vertically through driveshaft housing 24. A driveshaft 52 is journaled for rotation and is driven by the crankshaft 50.

The lower unit 26 depends from the driveshaft housing 24 and supports a propulsion shaft 54 that is driven by the driveshaft 52 through a transmission unit 56. A propulsion device is attached to the propulsion shaft 54. In the illustrated arrangement, the propulsion device is the propeller 57 that is fixed to the transmission unit 56. The propulsion device, however, can take the form of a dual counter-rotating system, a hydrodynamic jet, or any of a number of other suitable propulsion devices.

Preferably, at least three major engine portions 40, 42, 44, 46, and 48 are made of aluminum alloy. In some arrangements, the cylinder head cover members 44 can be unitarily formed with the respective cylinder members 42. Also, the crankcase cover member 48 can be unitarily formed with the crankcase member 46.

The engine 28 also comprises an air intake system 58. The air intake system 58 draws air from within the cavity 32 to the combustion chambers. The air intake system 58 shown comprises six intake passages 60 and a pair of plenum chambers 62. In the illustrated arrangement, each cylinder bank communicates with three intake passages 60 and one plenum chamber 62.

The most downstream portions of the intake passages 60 are defined within the cylinder head member 42 as inner intake passages. The inner intake passages communicate with the combustion chambers through intake ports, which are formed at inner surfaces of the cylinder head members 42. Typically, each of the combustion chambers has one or more intake ports. Intake valves are slidably disposed at each cylinder head member 42 to move between an open position and a closed position. As such, the valves act to open and close the ports to control the flow of air into the combustion chamber. Biasing members, such as springs, are used to urge the intake valves toward their respective closed positions by acting between a mounting boss formed on each cylinder head member 42 and a corresponding retainer that is affixed to each of the valves. When each intake valve is in the open position, the inner intake passage thus associated with the intake port communicates with the associated combustion chamber.

Other portions of the intake passages 60, which are disposed outside of the cylinder head members 42, preferably are defined with intake conduits 64. In the illustrated arrangement, each intake conduit 64 is formed with two pieces. One piece is a throttle body 66, in which a throttle valve assembly 68 is positioned. Throttle valve assemblies 68 are schematically illustrated in FIG. 2. The throttle bodies 66 are connected to the inner intake passages. Another piece is an intake runner 70 disposed upstream of the throttle body 66. The respective intake conduit 64 extend forwardly alongside surfaces of the engine 28 on both the port side and the starboard side from the respective cylinder head members 42 to the front of the crankcase cover member 48. The intake conduits 64 on the same side extend generally and parallel to each other and are vertically spaced apart from one another.

Each throttle valve assembly 68 preferably includes a throttle valve. Preferably, the throttle valves are butterfly valves that have valve shafts journaled for pivotal movement about generally vertical axis. In some arrangements, the valve shafts are linked together and are connected to a control linkage. The control linkage is connected to an operational member, such as a throttle lever, that is provided on the watercraft or otherwise proximate the operator of the watercraft 18. The operator can control the opening degree of the throttle valves in accordance with operator request through the control linkage. That is, the throttle valve assembly 68 can measure or regulate amounts of air that flow through intake passages 60 through the combustion chambers in response to the operation of the operational member by the operator. Normally, the greater the opening degree, the higher the rate of air flow and the higher the engine speed.

The respective plenum chambers 62 are connected with each other through one or more connecting pipes 72 (FIG. 3) to substantially equalize the internal pressures within each chamber 62. The plenum chambers 62 coordinate or smooth air delivered to each intake passage 60 and also act as silencers to reduce intake noise.

The air within the closed cavity 32 is drawn into the plenum chamber 62. The air expands within the plenum chamber 62 to reduce pulsations and then enters the outer intake passages 60. The air passes through the outer intake passage 60 and flows into the inner intake passages. The throttle valve assembly 68 measures the level of airflow before the air enters into the inner intake passages.

The engine 28 further includes an exhaust system that routes burnt charges, i.e., exhaust gases, to a location outside of the outboard motor 10. Each cylinder head member 42 defines a set of inner exhaust passages that communicate with the combustion chambers to one or more exhaust ports which may be defined at the inner surfaces of the respective cylinder head members 42. The exhaust ports can be selectively opened and closed by exhaust valves. The construction of each exhaust valve and the arrangement of the exhaust valves are substantially the same as the intake valve and the arrangement thereof, respectively. Thus, further description of these components is deemed unnecessary.

Exhaust manifolds preferably are defined generally vertically with the cylinder block 40 between the cylinder bores of both the cylinder banks. The exhaust manifolds communicate with the combustion chambers through the inner exhaust passages and the exhaust ports to collect the exhaust gas therefrom. The exhaust manifolds are coupled with the exhaust discharge passage of the exhaust guide member 38. When the exhaust ports are opened, the combustion chambers communicate with the exhaust discharge passage through the exhaust manifolds. A valve cam mechanism preferably is provided for actuating the intake and exhaust valves in each cylinder bank. In the embodiment shown, the valve cam mechanism includes second rotatable members such as a pair of camshafts 74 per cylinder bank. The camshafts 74 typically comprise intake and exhaust camshafts that extend generally vertically and are journaled for rotation between the cylinder head members 42 and the cylinder head cover members 44. The camshafts 74 have cam lobes (not shown) to push valve lifters that are fixed to the respective ends of the intake and exhaust valves in any suitable manner. Cam lobes repeatedly push the valve lifters in a timely manner, which is in proportion to the engine speed. The movement of the lifters generally is timed by rotation of the camshaft 74 to appropriately actuate the intake and exhaust valves.

The camshaft drive mechanism 76 preferably is provided for driving the valve cam mechanism. The camshaft drive mechanism 76 in the illustrated arrangement is formed above a top surface 78 (see FIG. 2) of the engine 28 and includes driven sprockets 80 positioned atop at least one of each pair of camshafts 74, a drive sprocket 82 positioned atop the crankshaft 50 and the flexible transmitter, such as a timing belt or chain 84, for instance, wound around the driven sprockets 80 and the drive sprocket 82. The crankshaft 50 thus drives the respective crankshaft 74 through the time belt 84 in the timed relationship.

The illustrated engine 28 further includes indirect, port or intake passage fuel injection. In one arrangement, the engine 28 comprises fuel injection and, in another arrangement, the engine 28 is carburated. The illustrated fuel injection system shown includes six fuel injectors 86 with one fuel injector allotted to each one of the respective combustion chambers. The fuel injectors 86 preferably are mounted on the throttle body 66 of the respective banks.

Figure 4:
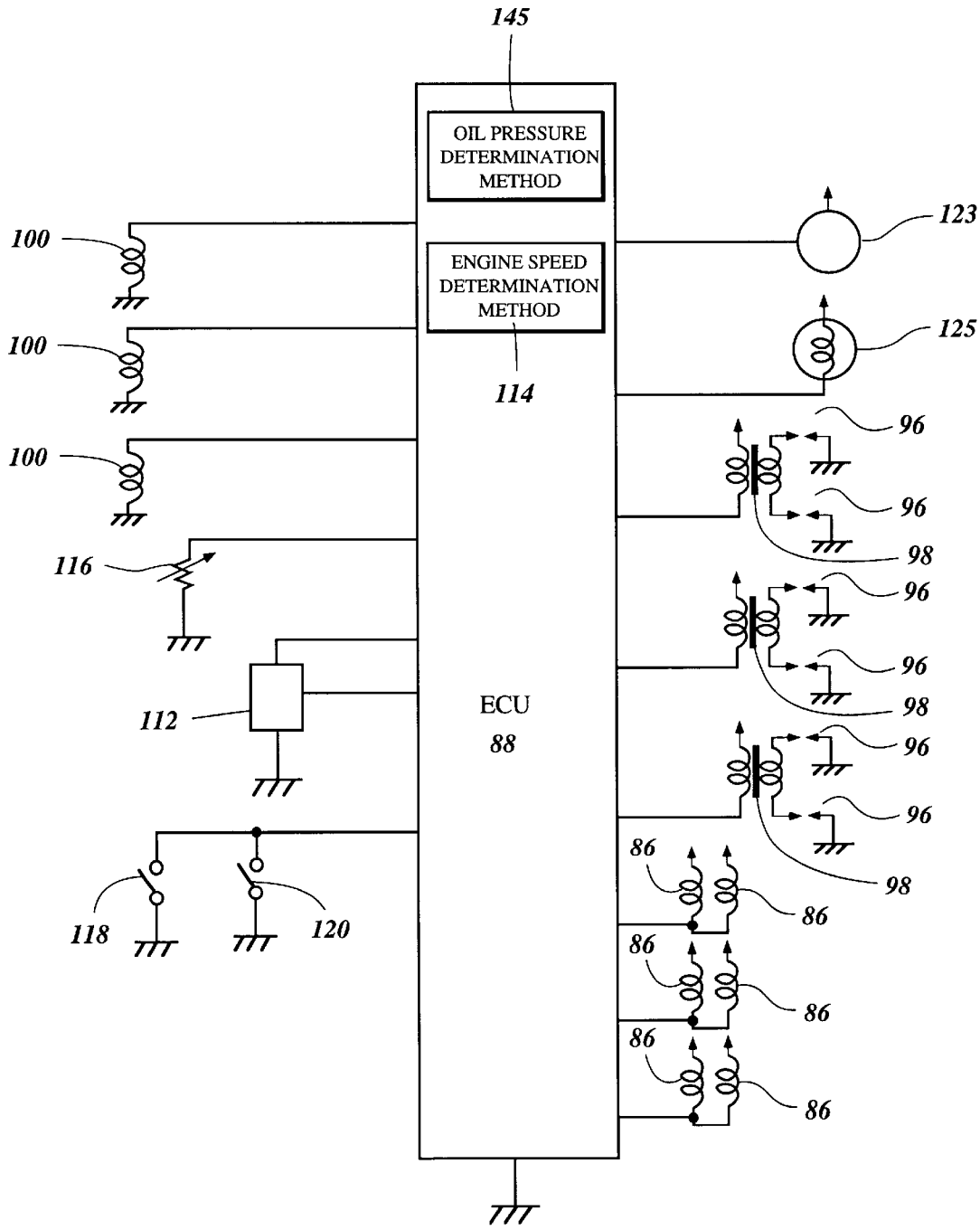
FIG. 4 is a schematic diagram of the electronic control unit and its control parameters.

Each fuel injector 86 has advantageously an injection nozzle directed downstream within the associated intake passage 60. The injection nozzle preferably is disposed downstream of the throttle valve assembly 60. The fuel injectors 86 spray fuel into the intake passages 60 under control of an electronic control unit (ECU) 88 (FIG. 4). The ECU 88 controls both the initiation, timing and the duration of the fuel injection cycle of the fuel injector 86 so that the nozzle spray a desired amount of fuel for each combustion cycle.

A vapor separator 90 preferably is in full communication with the tank and the fuel rails, and can be disposed along the conduits in one arrangement. The vapor separator 90 separates vapor from the fuel and can be mounted on the engine 28 at the side service of the port side.

The fuel injection system preferably employs at least two fuel pumps to deliver the fuel to the vapor separator 90 and to send out the fuel therefrom. More specifically, in the illustrated arrangement, a lower pressure pump 92, which is affixed to the vapor separator 90, pressurizes the fuel toward the vapor separator 90 and the high pressure pump (not shown), which is disposed within the vapor separator 90, pressurizes the fuel passing out of the fuel separator 90.

A vapor delivery conduit 94 couples the vapor separator 90 with at least one of the plenum chambers 62. The vapor removed from the fuel supply by the vapor separator 90 thus can be delivered to the plenum chambers 62 for delivery to the combustion chambers with the combustion air. In other applications, the engine 28 can be provided with a ventilation system arranged to send lubricant vapor to the plenum chamber(s). In such applications, the fuel vapor also can be sent to the plenum chambers via the ventilation system.

The engine 28 further includes an ignition system. Each combustion chamber is provided with a spark plug 96 (see FIG. 4), advantageously disposed between the intake and exhaust valves. Each spark plug 96 has electrodes that are exposed in the associated combustion chamber. The electrodes are spaced apart from each other by a small gap. The spark plugs 96 are connected to the ECU 88 through ignition coils 98. One or more ignition triggering sensors 100 are positioned around a flywheel assembly 102 to trigger the ignition coils, which in return trigger the spark plugs 96. The spark plugs 96 generate a spark between the electrodes to ignite an air/fuel charge in the combustion chamber according to desired ignition timing maps or other forms of controls.

Generally, during an intake stroke, air is drawn into the combustion chambers through the air intake passages 60 and fuel is mixed with the air by the fuel injectors 86. The mixed air/fuel charge is introduced to the combustion chambers. The mixture is then compressed during the compression stroke. Just prior to a power stroke, the respective spark plugs ignite the compressed air/fuel charge in the respective combustion chambers. The air/fuel charge thus rapidly burns during the power stroke to move the pistons. The burnt charge, i.e., exhaust gases, then is discharged from the combustion chambers during an exhaust stroke.

The flywheel assembly 102, which is schematically illustrated with phantom line in FIG. 3, preferably is positioned atop the crankshaft 50 and is positioned for rotation with the crankshaft 50. The flywheel assembly 102 advantageously includes a flywheel magneto for AC generator that supplies electric power directly or indirectly via a battery to various electrical components such as the fuel injection system, the ignition system and the ECU 88. An engine cover 104 preferably extends over almost all of the engine 28, including the flywheel assembly 102.

In the embodiment of FIG. 1, the driveshaft housing 24 defines an internal section of the exhaust system that leaves the majority of the exhaust gases to the lower unit 26. The internal section includes an idle discharge portion that extends from a main portion of the internal section to discharge idle exhaust gases directly to the atmosphere through a discharge port that is formed on a rear surface of the driveshaft housing 24.

Lower unit 26 also defines an internal section of the exhaust system that is connected with the internal exhaust section of the driveshaft housing 24. At engine speeds above idle, the exhaust gases are generally discharged to the body of water surrounding the outboard motor 10 through the internal sections and then a discharge section defined within the hub of the propeller 57.

The engine 28 may include other systems, mechanisms, devices, accessories, and components other than those described above such as, for example, a cooling system. The crankshaft 50 through a flexible transmitter, such as timing belt 84 can directly or indirectly drive those systems, mechanisms, devices, accessories, and components.

The Oil Pressure Control System

The illustrated engine includes a lubrication system to lubricate the moving parts within the engine 28. The lubrication system is a pressure fed system for lubricating the bearings and other rotating surfaces. The oil pressure control system described informs the operator of the status of the lubrication pressure in the engine and sounds an alarm if there is inadequate lubrication pressure.

Figure 5:
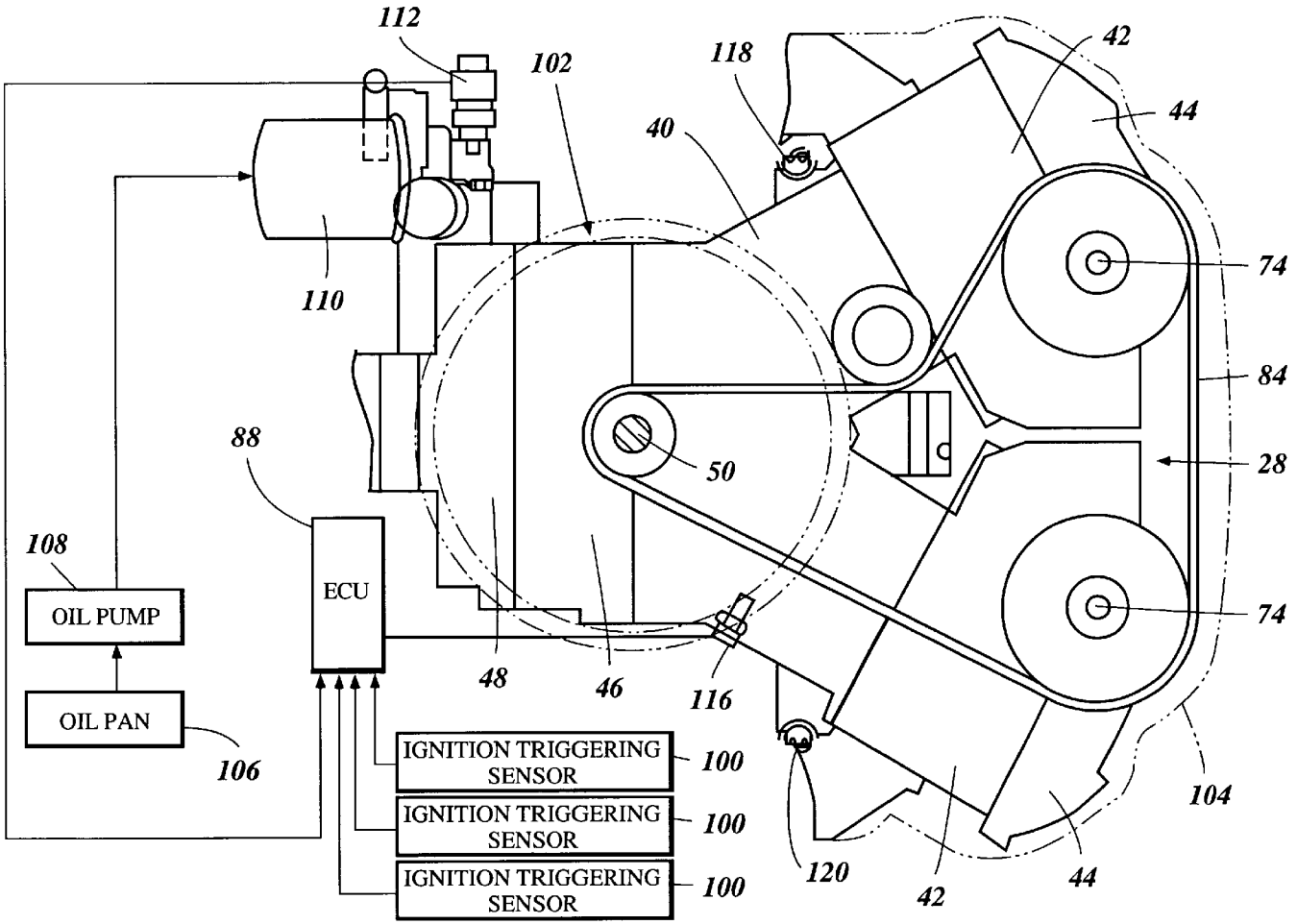
FIG. 5 is a top view of an outboard motor configured in accordance with a preferred embodiment of the present invention, with various electronically controlled parameters shown.

Referring to FIG. 5, the lubrication oil is collected from an oil pan 106 within the engine 28 by an oil pump 108 and is delivered under pressure through an oil filter 110. Referring to FIG. 4, an oil pressure sensor 112 measures the pressure of the lubrication system, which relays the information to the ECU 88. The lubricating oil may also travel through an oil thermostat and oil cooler in order to maintain a proper lubricating temperature. The oil is then dispersed throughout the engine to lubricate the internal moving parts. The oil pump 108 may be directly driven from the crankshaft 50. The oil pump 108 may also be driven by, for example, the camshafts 74, an intermediate shaft, or an auxiliary shaft.

Figure 6:
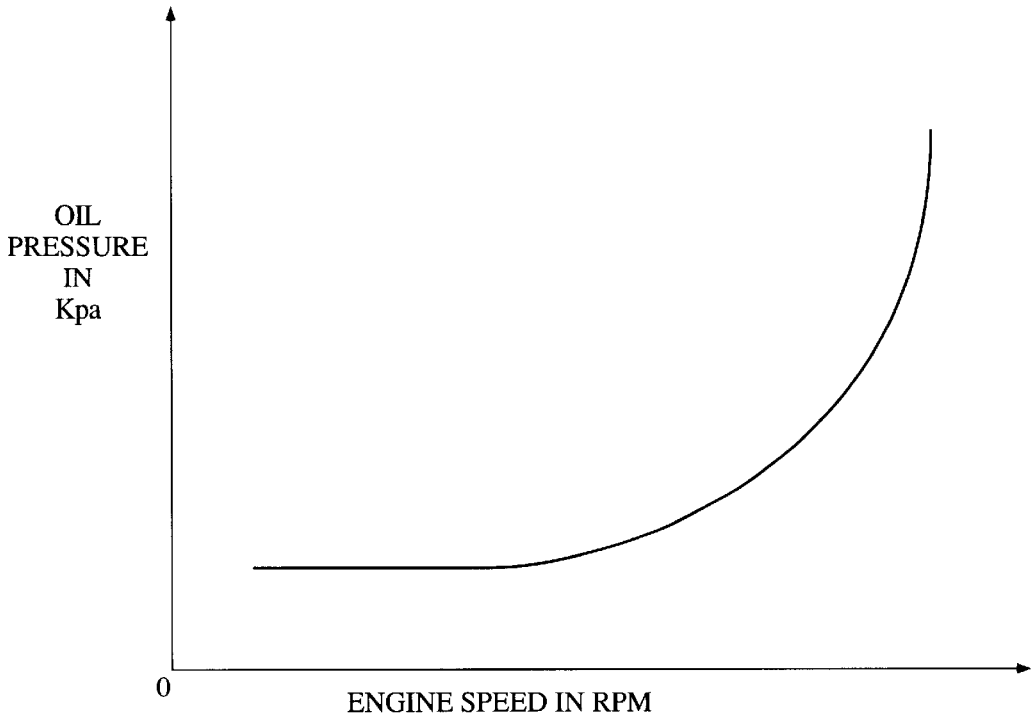
FIG. 6 is a graphical view showing engine oil pressure with reference to engine speed.

As illustrated in FIG. 6, the oil pressure advantageously rises as a function of engine speed. The engine speed is calculated by the ECU using the ignition triggering sensors 100 coupled to ECU 88. Thus, when the engine 28 is operating at idle or a low speed the corresponding oil pressure is less than when the engine is operating at a higher speed. At increasing engine speeds lubrication pressure becomes more important and vital to long engine life and proper engine operation.

Figure 7:
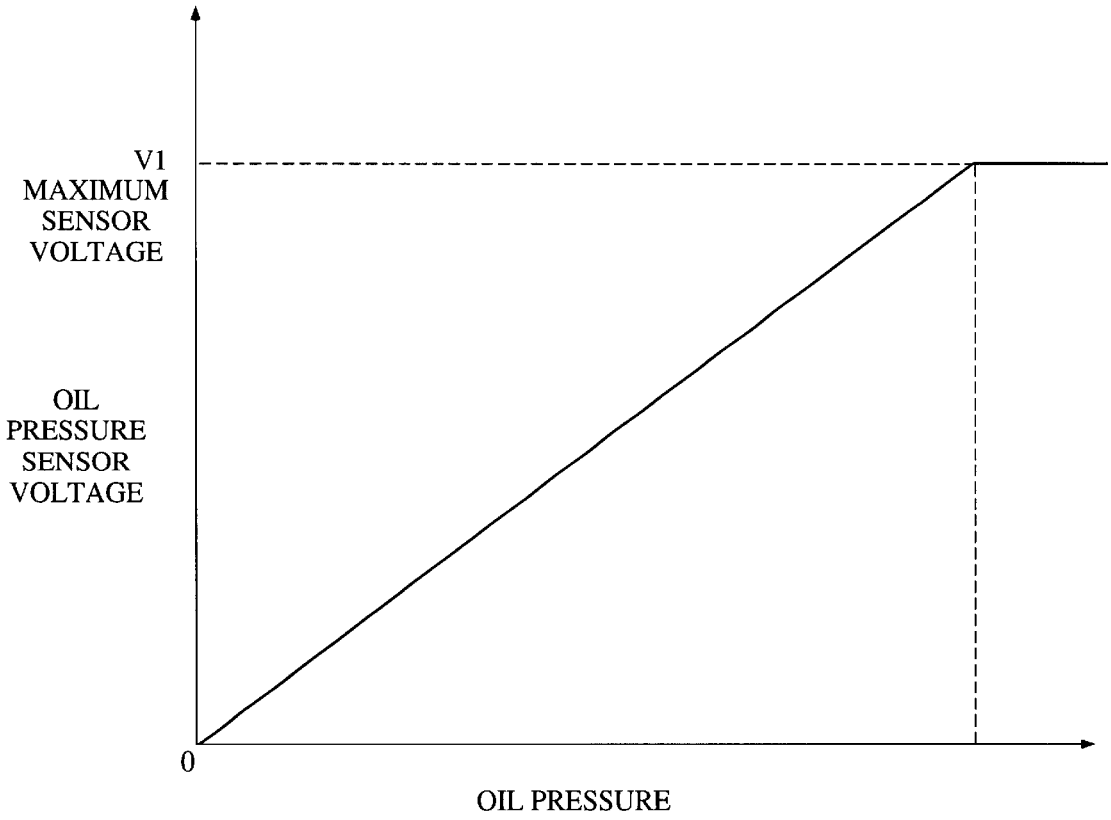
FIG. 7 is a graphical view showing the relationship between the oil pressure sending unit output voltage and the engine oil pressure.

The graph of FIG. 7 illustrates the relationship of the oil pressure sensor voltage and the actual pressure of the lubricating system. As the oil pressure rises, the oil pressure sensor voltage rises linearly. This oil pressure sensor voltage accurately represents the actual engine lubrication pressure for constant monitoring by the ECU 88.

The viscosity, or degree of resistance of a substance to oppose displacement forces, of the oil in the engine is higher at cold engine temperatures and decreases as the engine temperature rises. Therefore, the oil pressure will be higher in a cold engine at a particular engine speed than in a warm engine operating at the same speed. In a preferred embodiment the oil pressure control system incorporates an engine temperature sensor 116 located in the engine block 40 as well as oil temperature switches 118, 120 in each cylinder head member 42 to properly translate the engine and individual cylinder head temperatures to the ECU 88. The ECU 88 is programmed to use these temperature value inputs to accurately evaluate proper lubrication pressures for the engine 28.

In one embodiment of the present invention the predetermined oil pressure values are dependent on the engine speed. For example, at higher engine speeds the predetermined oil pressure threshold value is higher because a increased oil pressure is necessary to effectively lubricate and protect the rotating engine components. At a lower engine speed a lower oil pressure threshold is adequate to effectively lubricate and protect the rotating engine components. Therefore, the operator will be correctly warned at every engine speed if an inadequate oil pressure is present. As described above, ECU 88 is coupled to the ignition triggering sensors 108 and is programmed to initiate different oil pressure alarm timed sequences depending upon engine speed.

Figure 8:
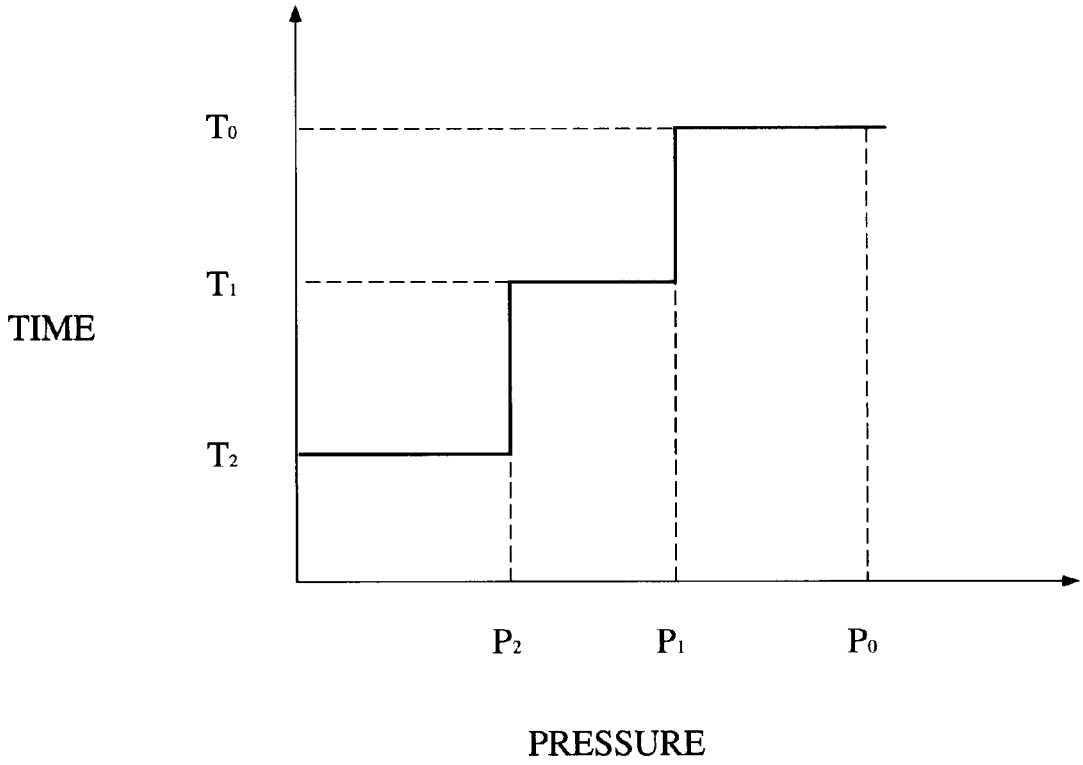
FIG. 8 is a graphical view showing the relationship between timer values and engine oil pressure.

A significant feature of the engine embodiment illustrated is that oil pressure alarm limits are also a function of predetermined time intervals. FIG. 8 illustrates a graph showing how different pressure threshold values, Po, P1, and P2 correspond to different timers To, T1, and T2. When a particular pressure is detected, the corresponding timer is activated. As the detected oil pressure becomes lower and passes a lower oil pressure threshold, a shorter timer is activated.

Figure 9:
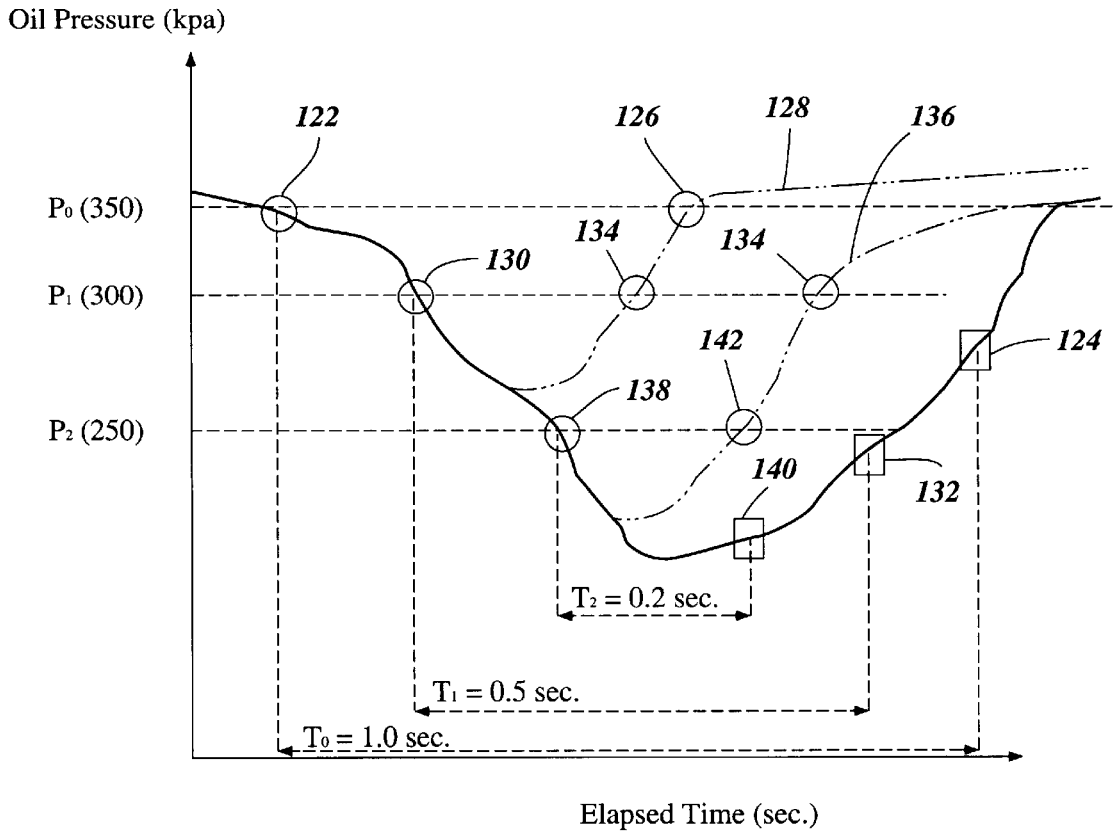
FIG. 9 is a graphical view showing various engine oil pressures with reference to time.

FIG. 9 illustrates examples of various changing oil pressure values, how the oil pressure control system monitors the oil pressure, and at which point the system triggers an alarm to warn the operator of a lapse of lubrication pressure. At a point 122 when an oil pressure value drops below an initial pressure threshold Po, a corresponding timer To is initiated. By way of specific example, the pressure Po may represent a pressure of 350 kilopascals (kpa) and To sets a predetermined time internal of one second. If the oil pressure remains below the initial pressure Po for the predetermined amount of time designated by the timer To, for example at point 124 one second later than point 122, an alarm system will be activated to warn the operator of inadequate oil pressure. The warning alarm system may include, but is not limited to, an audible alarm 123 and/or a visual alarm 125. If, however, during this time internal To, the oil pressure rises above the pressure threshold Po, for example at point 126 on a pressure trace depicted by a dashed line 128, the timer To is automatically reset and no alarm is activated.

In another example shown in FIG. 9, the oil pressure value drops below a second pressure threshold P1 and a corresponding timer T1 is initiated. By way of specific example, P1 may represent a pressure of 300 kpa and T1 is set to a time corresponding to 0.5 seconds. If during this time internal T1, the oil pressure remains below the second pressure P1 for the predetermined amount of time designated by the timer T1, for example at point 132 0.5 seconds later than point 130, an alarm will be activated to warn the operator of inadequate oil pressure. If, however, during the time interval T1, the oil pressure rises above the pressure threshold P1, for example at points 134 on pressure traces depicted by dashed lines 128 or 136, the timer T1 is reset and no alarm is activated.

At yet another point 138 when an oil pressure value drops below a third pressure threshold P2, a corresponding timer T2 is initiated. T2 can be set to a time corresponding to 0.2 seconds. P2 may represent a pressure of 250 kpa. If the oil pressure remains below the third pressure P2 for the predetermined amount of time designated by the timer T2, for example at point 140, an alarm will be activated to properly warn the operator of inadequate oil pressure. If, however the oil pressure at any time after the timer T2 begins rises above the pressure threshold P2, for example at point 142 on the pressure trace depicted by a dashed line 136, the timer T2 is reset and no alarm is activated.

Figure 10:
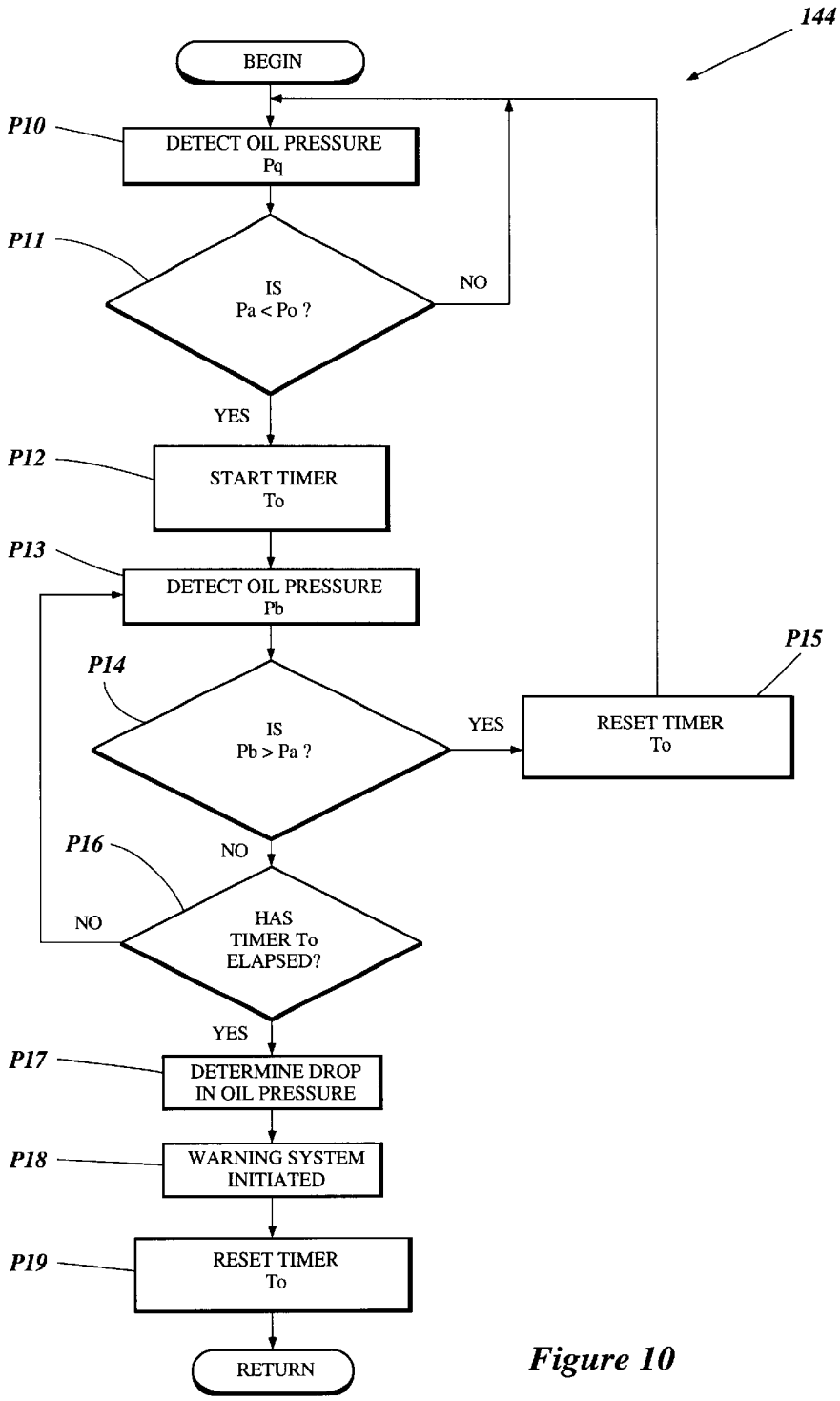
FIG. 10 is a flowchart representing a control routine arranged and configured in accordance with certain features, aspects, and advantages of the present invention.
Figure 11:
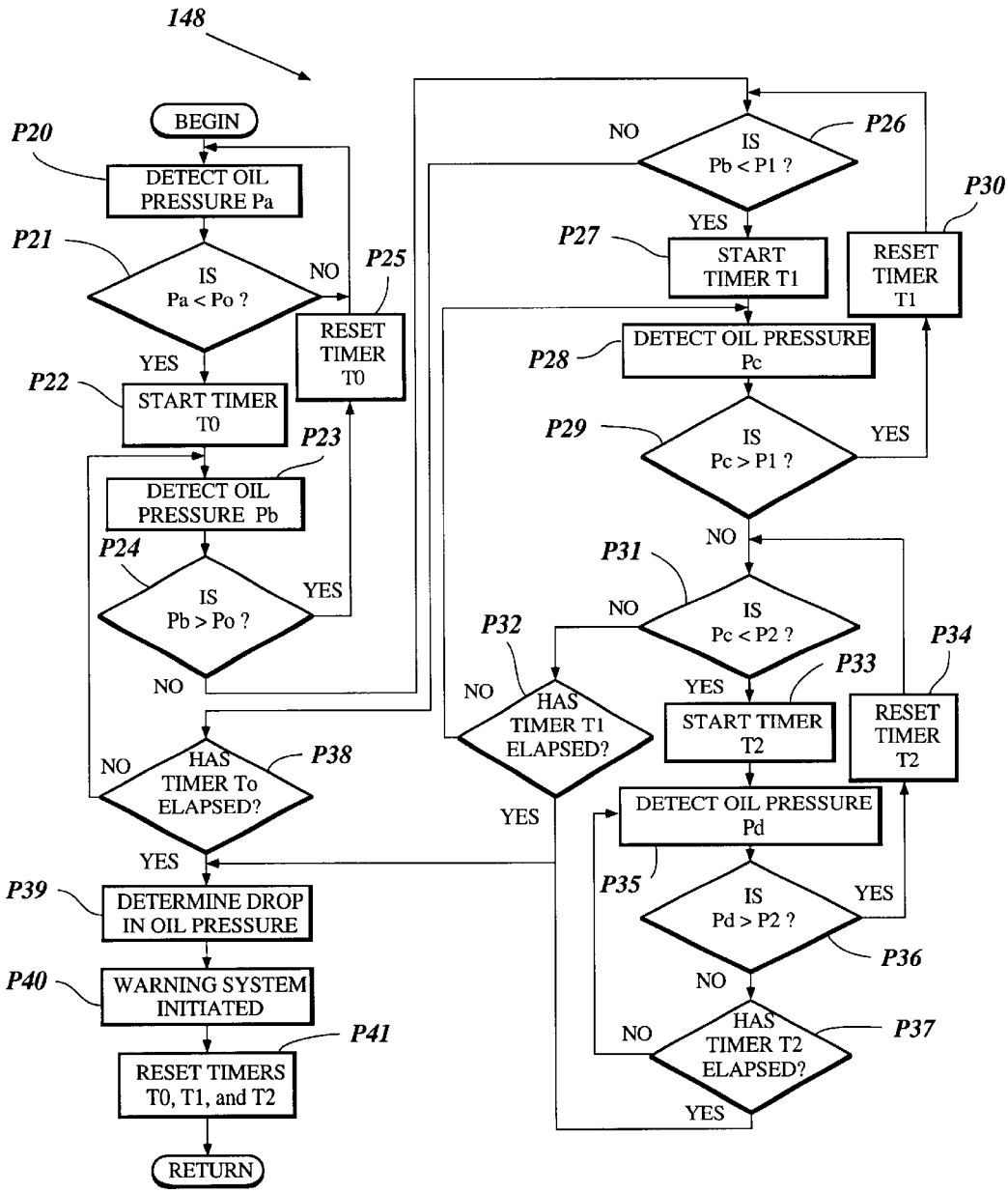
FIG. 11 is a flowchart representing another control routine arranged and configured in accordance with certain features, aspects, and advantages of the present invention.

The flow charts in FIGS. 10 and 11 further illustrate the function of the control system. The first flow chart in FIG. 10 corresponds to the oil pressure system using one pressure threshold to activate an alarm and properly warn the operator of an inadequate lubrication pressure. FIG. 11 shows another flow chart corresponding to the oil pressure system using three pressure thresholds to activate an alarm and properly warn the operator of an inadequate lubrication pressure.

FIG. 10 shows a control routine 144 of ECU 88 that is arranged and configured in accordance with certain features, aspects, and advantages of the present invention. The control routine 144 begins and moves to a first operation block P10 in which the engine oil pressure Pa is measured and stored. Advantageously, the ECU 88 is programmed to perform the oil pressure determination method. The control routine 144 then moves to decision block P11.

In decision block P11 it is determined if the measured pressure Pa is less than a threshold pressure Po. If the measured oil pressure Pa is not less than the threshold pressure Po, the control routine returns to the input of block P10. If, however, the measured pressure Pa is less than the threshold pressure Po, the control routine 144 moves to operation block P12.

In operation block P12, the timer To is started. The control routine 144 moves to operation block P13

In operation block P13 a second oil pressure Pb is detected. The control routine 144 moves to a decision block P14

In decision block P14 the second measured oil pressure Pb is compared to the threshold pressure Po. If the second measured pressure Pb is greater than the threshold pressure Po, the control routine 144 moves to operation block P15. If, however the second measured oil pressure Pb is not greater than the threshold pressure Po, the control routine 144 moves to decision block P16.

In operation block P15 the timer To is reset and the control routine 144 returns.

In decision block P16 it is determined if timer To has elapsed. If the timer To has not elapsed, the control routine 144 moves to the operation block P13. If, however, in decision block P16 the timer To has elapsed, the control routine 144 moves to operation block P17.

In operation block P17 a drop in oil pressure is determined. The control routine 144 moves to operation block P18.

In operation block P18 a warning system is initiated. The warning system may contain, but is not limited to, an audible alarm system and/or a visual alarm system. The control routine 144 moves to operation block P19.

In operation block P19 the timer To is reset and the control routine 144 returns.

FIG. 11 shows a control routine 148 of ECU 88 that is arranged and configured in accordance with certain features, aspects, and advantages of the present invention. The control routine 148 begins and moves to operation block P20 where an oil pressure Pa is measured and stored. The control routine 148 moves to decision block P21.

In decision block P21 it is determined if the measured oil pressure Pa is less than Po. If the measured pressure Pa is not less than the pressure threshold Po, the control routine 148 returns. If, however, the measured oil pressure Pa is less than the threshold pressure Po, the control routine 148 moves to operation block P22.

In operation block P22 a timer To is started. The timer To corresponds to the threshold pressure Po. The control routine 148 moves to operation block P23.

In operation block P23 a second oil pressure Pb is detected. The operation block 148 moves to decision block P24.

In decision block P24 it is determined if the second measured oil pressure Pb is greater than the threshold pressure Po. If the measured oil pressure Pb is greater than threshold pressure Po, the control routine 148 moves to operation block P25. If, however, in decision block P24 it is determined that the measured oil pressure Pb is not greater than the threshold pressure Po, the control routine 148 moves to decision block P26.

In operation block P25 the timer To is reset and the control routine 148 returns.

In decision block P26 it is determined if the second measured oil pressure Pb is less than a second threshold pressure P1. If the second measured oil pressure Pb is not less than the second oil pressure threshold P1, the control routine 148 moves to decision block P38. If, however in decision block P26 the second measured oil pressure Pb is less than the second threshold oil pressure P1, the control routine 148 moves to operation block P27.

In operation block P27 a timer T1 is started and the control routine 148 moves to operation block P28.

In operation block P28 a third oil pressure Pc is measured. The control routine 148 moves to decision block P29.

In decision block P29 it is determined if the third measured oil pressure Pc is greater than the second threshold pressure P1. If the third measured oil pressure Pc is greater than the second threshold oil pressure P1, the control routine 148 moves to operation block P30. If in decision block P29, it is determined that the third measured oil pressure PC is not greater than the second threshold pressure P1, the operation block P48 moves to decision block P31.

In operation block P30 the timer T1 is reset and the control routine 148 moves to the decision block P26.

In decision block P31 it is determined if the third measured oil pressure Pc is less than the third oil pressure threshold P2. If the third measured oil pressure Pc is not less than the third oil pressure threshold P2, the control routine 148 moves to decision block P32. If the second measured oil pressure Pc is less than the third oil pressure threshold P2, the control routine 148 moves to operation block P33.

In decision block P32 it is determined if the timer T1 has elapsed. If the timer T1 has elapsed, the control routine 148 moves to operation block P39. If the timer T1 has not elapsed, the control routine 148 returns to operation block P28.

In operation block P33 a timer T2 is started and the control routine 148 moves to operation block P35.

In operation block P35 a fourth oil pressure Pd is detected and the control routine 148 moves to decision block P36.

In decision block P36 it is determined if the fourth measured oil pressure Pd is greater than the third oil pressure threshold P2. If the fourth measured oil pressure Pd is greater than the third oil pressure threshold P2, the control routine 148 moves to operation block P34. If the fourth measured oil pressure Pd is not greater than the third pressure threshold P2, the control routine 148 moves to decision block P37.

In operation block P34 the timer T2 is reset and the control routine 148 moves to decision block P31.

In decision block P37, it is determined if the timer T2 has elapsed. If the timer T2 has not elapsed, the control routine 148 moves to operation block P35. If, however, the timer T2 has elapsed, the control routine 148 moves to operation block P39.

In operation block P39 a drop in oil pressure is determined and the control routine 148 moves to operation block P40.

In operation block P40 a warning system is initiated. The warning system may contain, but is not limited to, an audible alarm system and/or a visual alarm system. The control routine 148 moves to operation block P41.

In operation block P41 the timers T0, T1, and T2 are reset and the control routine 148 returns.

It is to be noted that embodiments of the control systems described above may be in the form of a hard-wired feedback control circuits. Alternatively, the control systems may be constructed of a dedicated processor and memory for storing a computer program configured to perform the steps described above in the context of the flowcharts. Additionally, the control systems may be constructed of a general-purpose computer having a general-purpose processor and memory for storing the computer program for performing the routines. Preferably, however, the control systems are incorporated into the ECU 88, in any of the above-mentioned forms.

Although the present invention has been described in terms of a certain preferred embodiments, other embodiments apparent to those of ordinary skill in the art also are within the scope of this invention. Thus, various changes and modifications may be made without departing from the spirit and scope of the invention. For instance, various steps within the routines may be combined, separated, or reordered. In addition, some of the indicators sensed (e.g., engine speed and throttle position) to determine certain operating conditions (e.g., rapid deceleration) can be replaced by other indicators of the same or similar operating conditions. Moreover, not all of the features, aspects and advantages are necessarily required to practice the present invention. Accordingly, the scope of the present invention is intended to be defined only by the claims that follow.

What is claimed is:

1. A warning system for a watercraft engine incorporating pressure fed lubrication for the moving parts of the engine comprising:

an oil pan within said engine, an oil pump having an inlet connected to said oil pan and an outlet dispersing oil throughout said engine to lubricate the moving parts of said engine, an oil pressure detector responsively coupled to detect the pressure of said pressurized oil, a timer setting a plurality of predetermined time periods, an alarm, a programmed computer responsively coupled to said oil pressure detector and said timer and operatively coupled to actuate said alarm after a predetermined period of time proportional to the detected oil pressure.

2. The warning system of claim 1, wherein said programmed computer comprises an electronic control unit that stores at least one predetermined oil pressure value.

3. The warning system of claim 2, wherein said electronic control unit determines engine speed.

4. The warning system of claim 3, wherein said predetermined oil pressure values are derived according to engine speed and said oil pressure detector.

5. The warning system of claim 4, wherein said predetermined oil pressure values are derived simultaneously.

6. The warning system of claim 1, wherein said predetermined period of time is longer for a high detected oil pressure.

7. The warning system of claim 1, wherein said predetermined period of time is shorter for a low detected oil pressure.

8. The warning system of claim 1, wherein said alarm provides an acoustical signal.

9. The warning system of claim 1, wherein said alarm provides a visual signal.

10. A warning system for a watercraft engine incorporating pressure fed lubrication for the moving parts of the engine comprising:

an oil pressure detector responsively coupled to detect the pressure of said pressurized oil, a timer setting a plurality of predetermined time periods, and an alarm, a programmed computer responsively coupled to said oil pressure detector and said timer and operatively coupled to actuate said alarm after a predetermined period of time proportional to the detected oil pressure.

11. The warning system of claim 10, wherein said programmed computer comprises an electronic control unit that stores at least one predetermined oil pressure value.

12. The warning system of claim 11, wherein said electronic control unit determines engine speed.

13. The warning system of claim 12, wherein said predetermined oil pressure values are derived according to engine speed and said oil pressure detector.

14. The warning system of claim 13, wherein said predetermined oil pressure values are derived simultaneously.

15. The warning system of claim 10, wherein said predetermined period of time is longer for a high detected oil pressure.

16. The warning system of claim 10, wherein said predetermined period of time is shorter for a low detected oil pressure.

17. The warning system of claim 10, wherein said alarm provides an acoustical signal.

18. The warning system of claim 10, wherein said alarm provides a visual signal.

19. A marine engine oil pressure warning system comprising:

an oil pressure detector coupled to a marine engine lubrication system, an electronic control unit (ECU) coupled to said detector, a timer and an alarm coupled to said ECU whereby said alarm is responsive to predetermined oil pressure values and predetermined time intervals correlating to said predetermined oil pressure values.

20. The marine engine oil pressure warning system of claim 19, wherein said electronic control unit stores at least one predetermined oil pressure value.

21. The marine engine oil pressure warning system of claim 20, wherein said oil pressure values are measured simultaneously.

22. The marine engine oil pressure warning system of claim 19, wherein said electronic control unit determines engine speed.

23. The marine engine oil pressure warning system of claim 22, wherein said predetermined oil pressure values are derived according to engine speed and said oil pressure detector.

24. The marine engine oil pressure warning system of claim 19, wherein aid timer is set to time intervals dependent on corresponding oil pressure limits.

25. The marine engine oil pressure warning system of claim 24, wherein said time intervals vary in length depending on the detected oil pressure value.

26. The marine engine oil pressure warning system of claim 24, wherein said time intervals are longer for a detected high oil pressure.

27. The marine engine oil pressure warning system of claim 24, wherein said time intervals are shorter for a detected low oil pressure.

28. The marine engine oil pressure warning system of claim 19, wherein said alarm provides an acoustical signal.

29. The marine engine oil pressure warning system of claim 19, wherein said alarm provides a visual signal.

30. A warning system for a watercraft engine incorporating pressure fed lubrication for the moving parts of the engine comprising:

an oil pan within said engine, an oil pump having an inlet connected to said oil pan and an outlet dispersing oil throughout said engine to lubricate the moving parts of said engine, an oil pressure detector responsively coupled to detect the pressure of said pressurized oil, a timer setting a first time period, a second time period and a third time period, said second time period being shorter than said first time period and said third time period being shorter than said second time period, an alarm programmed computer responsively coupled to said oil pressure detector and said timer and operatively coupled to actuate said alarm after a predetermined period of time proportional to the detected oil pressure, said alarm triggered at the end of said first time period when the detected oil pressure drops to a first pressure, said alarm triggered at the end of said second time period when the detected oil pressure drops to a second pressure which is lower than said first pressure and said alarm triggered at the end of said third time period when the detected oil pressure drops to a third pressure which is lower than said second pressure.

31. The warning system of claim 30, wherein said first time period is about 1 second, said second time period is about 0.5 seconds, and said third time period is about 0.2 seconds.

32. The warning system of claim 31, wherein said first pressure is about 350 kpa, said second pressure is about 300 kpa, and said third pressure is about 250 kpa.

* * * * *